US009970653B2

(12) United States Patent
Ilchenko et al.

(10) Patent No.: US 9,970,653 B2
(45) Date of Patent: May 15, 2018

(54) MOBILE HEATING UNIT OPERATED BY MEANS OF LIQUID FUEL

(71) Applicant: WEBASTO SE, Stockdorf (DE)

(72) Inventors: Volodymyr Ilchenko, Gilching (DE); Vitali Dell, Munich (DE)

(73) Assignee: WEBASTO SE, Stockdorf (DE)

( * ) Notice: Subject to any disclaimer, the term of this patent is extended or adjusted under 35 U.S.C. 154(b) by 591 days.

(21) Appl. No.: 14/379,932

(22) PCT Filed: Feb. 22, 2013

(86) PCT No.: PCT/DE2013/100069

§ 371 (c)(1),
(2) Date: Aug. 20, 2014

(87) PCT Pub. No.: WO2013/127391

PCT Pub. Date: Sep. 6, 2013

(65) Prior Publication Data

US 2015/0027428 A1 Jan. 29, 2015

(30) Foreign Application Priority Data

Feb. 27, 2012 (DE) ..... 10 2012 101 577
Feb. 22, 2013 (WO) ..... PCT/DE2013/100069

(51) Int. Cl.
*F23C 3/00* (2006.01)
*F23C 7/00* (2006.01)
(Continued)

(52) U.S. Cl.
CPC ..... *F23C 7/002* (2013.01); *F23C 3/00* (2013.01); *F23C 7/004* (2013.01); *F23C 9/006* (2013.01);
(Continued)

(58) Field of Classification Search
CPC ..... F23L 9/02; F24H 9/1881; F24H 3/006; F23M 3/12; F23C 7/002; F23C 3/00;
(Continued)

(56) References Cited

U.S. PATENT DOCUMENTS 2,619,160 A * 11/1952 Korshak ..... B60H 1/2212 126/110 R
3,103,923 A * 9/1963 Kofink ..... B60H 1/2212 126/116 R
(Continued)

FOREIGN PATENT DOCUMENTS

CN 1073000 A 6/1993
CN 1120145 A 4/1996
(Continued)

OTHER PUBLICATIONS

International Search Report dated May 31, 2013 in connection with PCT/DE2013/100069.
(Continued)

*Primary Examiner* — Alfred Basichas
(74) *Attorney, Agent, or Firm* — Quarles & Brady LLP

(57) ABSTRACT

A mobile heating device operated with liquid fuel is provided, having: a combustion chamber (2) comprising a combustion air inlet (3), wherein the combustion chamber (2) adjacent to the combustion air inlet (3) comprises a widening portion (20) the cross-section of which widens with increasing distance from the combustion air inlet (3) and in which in operation combustion air and fuel are converted in a flaming combustion; a fuel supply which is arranged such that fuel is supplied into the widening portion (20); and an air guide device (6) being adapted to feed combustion air into the widening portion (20) with a flow component directed in the circumferential direction such that an axial recirculation region forms in the widening portion (20) in which gases flow in the direction towards the
(Continued)

combustion air inlet (3) oppositely to a main flow direction (H).

15 Claims, 3 Drawing Sheets

(51) Int. Cl.
*F23C 9/00* (2006.01)
*F23D 3/40* (2006.01)
*F23D 11/24* (2006.01)

(52) U.S. Cl.
CPC ..... *F23D 3/40* (2013.01); *F23D 11/24* (2013.01); *F23D 2900/05002* (2013.01); *F23D 2900/21002* (2013.01)

(58) Field of Classification Search
CPC ..... F23C 7/02; F23C 2201/10; F23C 7/004; F23C 9/006; F23D 11/24; F23D 2900/05002; F23D 5/18; F23D 2900/21002; F23D 3/40; B60H 1/2212
See application file for complete search history.

(56) References Cited

U.S. PATENT DOCUMENTS

| | | | |
|---|---|---|---|
| 3,402,985 | A | 9/1968 | Galvin |
| 3,694,135 | A | 9/1972 | Dancy et al. |
| 3,975,141 | A | 8/1976 | Sweet |
| 5,449,288 | A | 9/1995 | Bass |
| 6,027,334 | A | 2/2000 | Blaschke |
| 2004/0047778 | A1 | 3/2004 | Wolf et al. |
| 2005/0072777 | A1 | 4/2005 | Kim et al. |

FOREIGN PATENT DOCUMENTS

| | | | |
|---|---|---|---|
| CN | 1386182 | A | 12/2002 |
| CN | 101280922 | A | 10/2008 |
| CN | 101666489 | A | 3/2010 |
| CN | 101782230 | A | 7/2010 |
| CN | 102174338 | A | 9/2011 |
| DE | 2534066 | C2 | 8/1985 |
| DE | 4216523 | A1 | 12/1993 |
| DE | 195 29 994 | A1 | 5/1995 |
| DE | 69016281 | T2 | 7/1995 |
| DE | 102004020129 | B3 | 8/2005 |
| DE | 10144407 | B4 | 5/2007 |
| DE | 10 2008 055981 | A1 | 5/2010 |
| RU | 2132018 | C1 | 6/1999 |
| RU | 2206827 | C1 | 6/2003 |
| RU | 2443941 | C1 | 2/2012 |
| WO | 9615408 | A1 | 5/1996 |
| WO | 2011108273 | A1 | 9/2011 |

OTHER PUBLICATIONS

Li Yun, Research on the Optimized Interior Combustor Structure of the YJH-Q5/1 Parking Heater, Dissertation for the Degree of Master, Jun. 2011 [English Language Abstract Included].

* cited by examiner

MOBILE HEATING UNIT OPERATED BY MEANS OF LIQUID FUEL

The present invention relates to a mobile heating device operated with liquid fuel.

In the present context, a "mobile heating device" is to be understood as heating device which is adapted for use in mobile applications and designed accordingly. This means in particular that it is transportable (fixedly mounted in a vehicle or only arranged therein for transport, as the case may be) and not exclusively adapted for continuous, stationary use, as is the case in the heating of a building. The mobile heating device may also be fixedly installed in a vehicle (land vehicle, boat, etc.), in particular in a land vehicle. In particular, it can be adapted for heating a vehicle interior, such as for instance of a land vehicle, boat, or aircraft, and a partly open room, as can be found for example on boats, in particular on yachts. The mobile heating device can also temporarily be used stationary, such as for example in big tents, containers (e.g. containers for construction sites), etc. According to a preferred further development, the mobile heating device is adapted as a parking heater or auxiliary heater for a land vehicle, such as for example for a mobile home, a caravan, a bus, a car, etc.

Mobile heating devices often are used e.g. as vehicle heating devices for heating a vehicle. In applications in a vehicle, such mobile heating devices are e.g. employed as auxiliary heaters which can provide additional heat when the propulsion engine of the vehicle is running or as parking heaters which can provide heat for heating purposes both when the propulsion engine is running and when it is at rest. In such mobile heating devices it is required that these shall, on the one hand, be operable with low heating power down to below 1 kW and, on the other hand, shall comprise a band width of heating powers being as large as possible, such that very different heating powers can be provided depending on the demand.

Usually, in mobile heating devices burners are used which are provided in a combustion chamber with components for flame stabilization, such as in particular constrictions, neckings or other components reaching into the region of the flame and of the hot gases flowing away, in order to enable as much as possible stable operation at different heating powers. Such components are subjected to particularly high loads during operation of the mobile heating device and often form those components which restrict the lifetime of the heating device.

It is an object of the present invention to provide an improved mobile heating device operated with liquid fuel.

The object is solved by a mobile heating device operated with liquid fuel according to claim 1. Advantageous further developments are defined in the dependent claims.

The mobile heating device operated with liquid fuel comprises: a combustion chamber comprising a combustion air inlet, wherein the combustion chamber adjacent to the combustion air inlet comprises a widening portion the cross-section of which widens with increasing distance from the combustion air inlet and in which in operation combustion air and fuel are converted in a flaming combustion; a fuel supply which is arranged such that fuel is supplied into the widening portion; and an air guide device being adapted to feed combustion air into the widening portion with a flow component directed in the circumferential direction such that an axial recirculation region forms in the widening portion in which gases flow in the direction towards the combustion air inlet oppositely to a main flow direction.

In the present context, a combustion chamber has to be understood as a region of the heating device in which flaming conversion of fuel and combustion air takes place. In particular, in the context of the present description the term combustion chamber does not mean the wall surrounding this region which can e.g. be formed by a plurality of components. Flaming combustion takes place at least also in the widening portion and not only in a region of the combustion chamber situated further downstream. By the air guide device which provides the air entering at the combustion air inlet so strongly with a flow component directed in the circumferential direction (i.e. with a strong swirl) that an axial recirculation region forms in the widening portion in which gases flow in the direction towards the combustion air inlet oppositely to the main flow direction, combustion which is low in emissions and stable is achieved with which operation over a large bandwidth of heating powers is enabled without requiring additional flame-stabilizing components protruding into the combustion chamber. Due to the defined geometric design and to the formation of the recirculation region it is achieved that the flame always spreads out stably starting from the widening portion also at different heating powers, i.e. different flow rates of fuel and combustion air. In this manner, the flame stabilizes itself in the combustion chamber. Formation of the recirculation region can easily be achieved by the widening portion widening strong enough, e.g. with a half cone angle of at least 20°, and by the supplied combustion air being provided with a sufficiently large flow component directed in the circumferential direction, in particular with a swirl factor of at least 0.6. Half cone angle means the angle between the longitudinal axis and the wall of the widening portion. Preferably, the fuel is supplied to the widening portion at the combustion air inlet, since in this case particularly advantageously pre-mixing of fuel and combustion air can take place.

According to a further development, the fuel supply comprises at least one evaporator element for evaporating the liquid fuel. In contrast to a fuel supply which only possesses an atomizer nozzle for atomizing the fuel, use of the evaporator element enables stable operation of the mobile heating device also at low heating powers below 1 kW, i.e. low flow rates of fuel and combustion air. Further, in this manner stable operation is enabled even in the case of formation of air bubbles in a fuel supply line because the evaporator element acts as a buffer. Furthermore, the evaporator element permits use of different liquid fuels, since effects due to different boiling temperatures and evaporation enthalpies are attenuated by the evaporator element.

According to a further development, the at least one evaporator element is arranged such that it at least partially surrounds the combustion air inlet. In this case, symmetric supply of evaporated fuel is achieved such that particularly homogeneous mixing of combustion air and fuel is attained which enables combustion with low emissions. If the at least one evaporator element ring-shaped surrounds the combustion air inlet, particularly symmetric supply of evaporated fuel is enabled.

According to a further development, the at least one evaporator element is thermally coupled to the widening portion. In this case, the evaporation process of liquid fuel in and on the evaporator element can be maintained by heat from the flame in the widening portion. Due to the given design of the combustion chamber, much heat for evaporating fuel is supplied to the evaporator element at high heating power, when a high flow rate of fuel is required, and correspondingly less heat at a lower heating power, i.e. a lower flow rate of fuel. The evaporator element can e.g. be covered in the direction towards the combustion chamber by a cover, preferably a metal sheet, which forms the wall of the widening portion. Heat transfer to the evaporator element can be effected by thermal conduction via the metal sheet. Due to the given design of the combustion chamber which results in reliable anchoring of the flame in the widening portion, heat transfer from the flame into the wall of the widening portion takes place reliably also at different heating powers. This heat transfer takes mainly place via convection. Since vortices form at the wall of the widening portion due to the design of the combustion chamber, the heat transfer to the evaporator element necessary for evaporation reliably takes place also at different heating powers.

According to a further development, the evaporator element is partly covered by a cover such that a fuel discharge portion is formed in a region which is not covered. In this case it can be reliably achieved that liquid fuel is evenly distributed in the evaporator element such that the whole evaporator element is used for evaporation of fuel and formation of deposits in the evaporator element is suppressed. Preferably, supply of liquid fuel to the evaporator element is effected in a region of the evaporator element which is far away from the fuel discharge portion and in which the evaporator element is covered by the cover. If the cover forms a wall of the widening portion, the resulting heat input into the evaporator element can be adjusted in a simple way by appropriate construction of the cover, in particular with regard to material and wall thickness.

If the fuel discharge portion is arranged at the combustion air inlet, particularly reliable mixing of combustion air and evaporated fuel can take place.

According to a further development, the evaporator element is arranged such that evaporated fuel exits with a directional component which is directed opposite to the main flow direction. In this case, particularly effective mixing of combustion air and fuel is achieved immediately at the combustion air inlet. The fuel can also comprise other directional components during exit, in particular a radial directional component in a direction towards a longitudinal axis of the combustion chamber.

According to a further development, the widening portion comprises a continuously widening cross-section. The widening portion can in particular be formed as conically widening. By the design with a continuously widening cross-section, undesired eddies can be prevented which would form in the case of a step-like widening cross-section.

According to a further development, the widening portion widens with an opening angle of at least 20°. In this case, a construction of the widening portion is provided which acts as a discontinuous widening of the flow cross-section from the point of view of fluid dynamics. In combination with the supply of combustion air with the flow component directed in the circumferential direction, reliable flame anchoring in the widening portion is achieved also at different heating powers.

According to a further development, the air guide device is formed such that the combustion air is supplied into the widening portion with a swirl factor of at least 0.6. The swirl factor ($S_N$) is an integral value which defines the relation of the tangential flow momentum to the axial flow momentum. With a swirl factor of at least 0.6, a fully formed recirculation zone is reliably attained.

According to a further development, the mobile heating device is adapted such that the combustion air is supplied into the combustion air inlet with flow velocities being higher than the turbulent flame velocities arising in the combustion chamber. In this case, it is reliably ensured that no flame can form immediately at the combustion air inlet such that burning-back of the flame to the fuel supply is prevented. Furthermore, in this case pre-mixing of fuel and combustion air can take place in a region immediately adjacent to the combustion air inlet, which results in a combustion being particularly low in emissions.

According to a further development, the combustion chamber continuously has a free flow cross-section. A continuously free flow cross-section means that no components hindering a flow in the axial direction of the combustion chamber, such as e.g. flame baffles, constrictions or the like, are provided. In this case, no components are provided in the combustion chamber which in conventional heating devices often reduce the lifetime due to the high load during operation, such that a mobile heating device having a long lifetime can be provided. It has to be noted that components necessary for operation, such as in particular ignition elements and/or sensors, having only negligible influence on the flow may protrude into the combustion chamber, as the case may be.

According to a further development, the combustion chamber—adjacent to the widening portion—has a portion with across-section remaining substantially constant. In this case, the flow characteristics in the combustion chamber are particularly advantageously adjustable. The portion having a cross-section remaining substantially constant can in particular be formed by an at least substantially hollow-cylindrical combustion chamber wall.

Further developments and advantages will become apparent from the following description of embodiments with reference to the enclosed drawings.

FIRST EMBODIMENT

A first embodiment will be described in the following with reference to FIGS. 1 to 5.

In the first embodiment, the mobile heating device operated with liquid fuel is in particular formed as a parking heater or auxiliary heater for a vehicle, in particular for a land vehicle. In the figures, only the burner 1 of the mobile heating device is illustrated. Further to the illustrated burner 1, the mobile heating device comprises in particular in a per se known manner a heat exchanger for transferring heat to a medium to be heated, such as in particular a liquid in a liquid circuit of a vehicle or air to be heated. The heat exchanger can for example cup-like surround the burner 1 in a per se known manner. Further, the mobile heating device comprises at least one fuel supply device, which can in particular be formed by a fuel pump; a combustion air conveying device, which can e.g. comprise a combustion air blower; and at least one control unit for controlling the mobile heating device.

Figure 1:
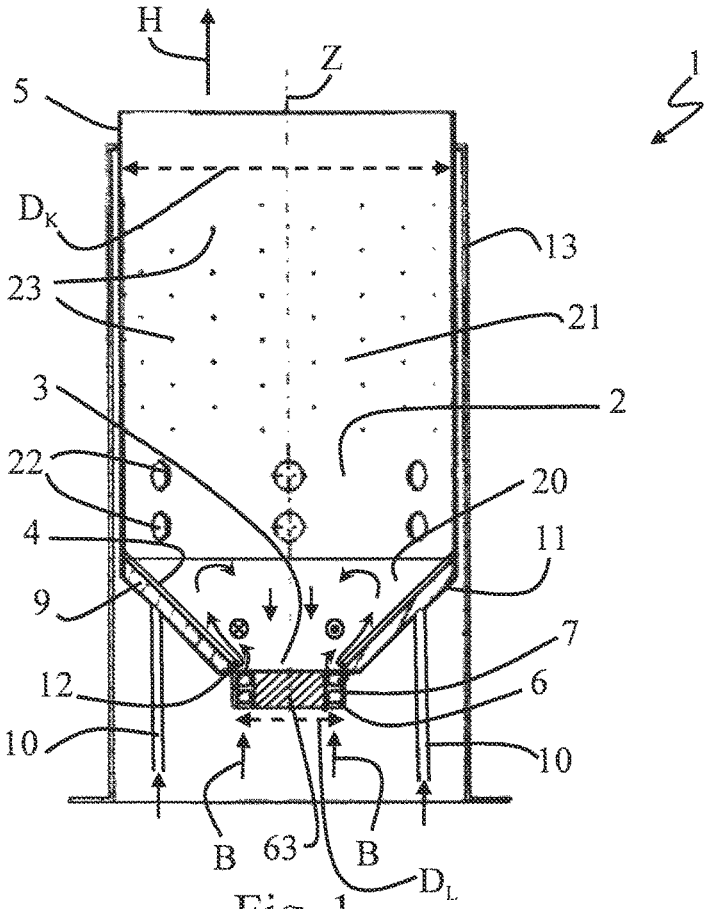
FIG. 1 is a schematic sectional illustration of the burner of a mobile heating device according to a first embodiment.

In the following, the burner 1 of the mobile heating device will be described more in detail with reference to FIGS. 1 to 5. The burner 1 comprises a combustion chamber 2 in which fuel and combustion air are converted in a flaming combustion during operation of the mobile heating device. In FIG. 1, the burner 1 is illustrated in a schematic sectional illustration, wherein the sectional plane is chosen such that a longitudinal axis Z of the burner 1 lies in the sectional plane. The burner 1 is formed substantially rotationally symmetric with regard to the longitudinal axis Z. The combustion chamber 2 comprises a combustion air inlet 3 at which combustion air is supplied into the combustion chamber 2 during operation.

Immediately adjacent to the combustion air inlet 3, the combustion chamber 2 comprises a widening portion 20 the cross-section of which widens with increasing distance from the combustion air inlet 3. In the depicted embodiment, the widening portion is confined by a conical wall which is formed by a cover 4 which will be described more in detail below. In a main flow direction H, a substantially cylinder-jacket-shaped wall 5 adjoins the conical wall of the widening portion 20, such that the combustion chamber 2 comprises a portion 21 having a cross-section remaining substantially constant adjacent to the widening portion 20. The size relations are chosen such that the diameter relation V between the outer diameter $D_L$ of the air guide device 6 and the diameter $D_K$ of the portion 21 of the combustion chamber 2 is smaller or equal to 0.5 ($V=D_L/D_K$ and $V\leq 0.5$).

The widening portion 20 widens with an opening angle of at least 20°. The opening angle is the angle which is formed between the wall of the widening portion 20 and the longitudinal axis Z. In the depicted embodiment, the opening angle amounts to e.g. between 40° and 50°. The combustion chamber 2 comprises an overall free flow cross-section so that no components hindering a free flow of gases protrude laterally into the combustion chamber 2 such that the gas flows in the combustion chamber 2 can develop according to the geometry of the widening portion 20 and of the adjacent portion 21, as will be described more in detail below.

Upstream of the combustion air inlet 3, an air guide device 6 is provided which is adapted in order to introduce the combustion air into the widening portion with a flow component directed in the circumferential direction. The air guide device 6 is formed such that a very large swirl is impressed onto the combustion air. The air guide device 6 is formed such that the air is introduced into the combustion air inlet 3 with a swirl factor of at least 0.6. The burner 1 is adapted such that a decrease in pressure in a range between 2 mbar and 20 mbar occurs over the air guide device 6. The air guide device 6 will be described more in detail with reference to FIGS. 3 and 4.

Figure 3:
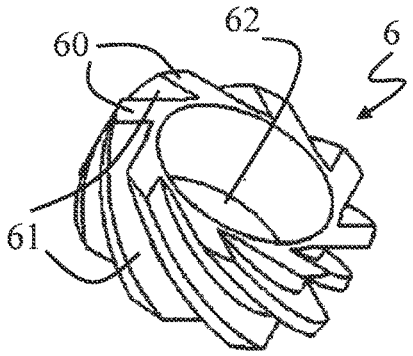
FIG. 3 is a schematic perspective illustration of an air guide device in the burner from FIG. 1.
Figure 4:
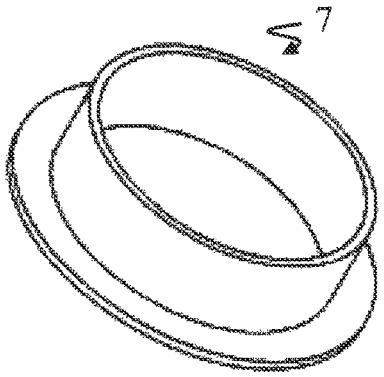
FIG. 4 is a schematic illustration of a housing surrounding the air guide device depicted in FIG. 3.

In the embodiment, the air guide device 6 comprises an approximately ring-shaped shape and is provided on the outside with spirally extending guide blades 60 between which also spirally extending channels 61 are formed. In the mobile heating device according to the embodiment, the air guide device 6 is inserted in a substantially hollow-cylindrical casing 7, which is illustrated in FIG. 4. The air guide device 6 is inserted in the casing 7 such that the spirally extending channels 61 are circumferentially closed by the casing 7. Thus, the spirally extending channels 61 are only open at their respective face sides such that combustion air can pass through. In FIG. 3 it is illustrated that the air guide device 6 is provided with a central cylindrical through-bore 62. This through-bore 62 can e.g. be used as lead through into the combustion chamber 2 for an ignition element. In the illustrated embodiment, the through-bore 62 is however closed by a plug 63 in the assembled state of the burner 1, as illustrated in FIG. 1.

In the first embodiment, the air guide device 6 is arranged such that combustion air at one face side enters into the channels 61 closed by the casing 7, flows through the spirally extending channels 61, and is introduced into the widening portion 20 of the combustion chamber 2 at the combustion air inlet 3 at their other face side. The combustion air is impressed with a swirl by the spirally-shaped design of the channels 61. The channels 61 are formed such that the combustion air is impressed with the required swirl factor of at least 0.6 when passing through. As schematically illustrated in by arrows B in FIG. 1, the combustion air is supplied to the air guide device 6 by a combustion air conveying device (not shown) which can e.g. comprise a blower.

Due to the described design of the air guide device 6, the combustion air is introduced at the combustion air inlet 3 into the widening portion 20 with a flow component directed hi the circumferential direction.

In the first embodiment, further a fuel supply is provided such that fuel is also supplied into the widening portion 20 at the combustion air inlet 3, as schematically illustrated by arrows in FIG. 1. The mobile heating device is designed for operation with liquid fuel and can e.g. be operable with fuel which is also used for a combustion engine of a vehicle, in particular diesel, benzine and/or ethanol. In the first embodiment, the fuel supply comprises at least one evaporator element 9 for evaporating supplied liquid fuel.

Figure 5:
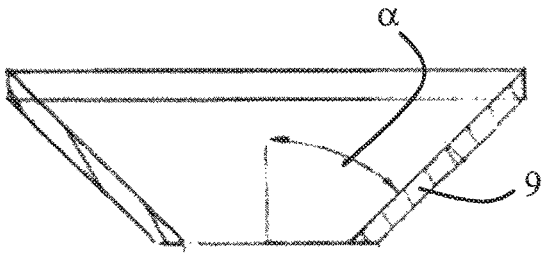
FIG. 5 is a schematic illustration of an evaporator element in the first embodiment.

In the first embodiment, the evaporator element 9 has the shape of a truncated hollow cone, as can be seen in FIG. 5. The evaporator element 9 comprises an opening angle $\alpha$ which corresponds to the opening angle of the widening portion 20. The evaporator element 9 is formed from a porous and heat-resistant material and can in particular comprise metal non-woven fabric, metal network and/or metal woven fabric. As illustrated in FIG. 1, a plurality of fuel lines 10 for supplying liquid fuel to the evaporator element 9 is provided. Although exemplarily two fuel lines 10 are illustrated in FIG. 1, also e.g. only one fuel line 10 can be provided or more fuel lines 10 can be provided.

At a side facing away from the combustion chamber 2, the evaporator element 9 is covered by a rear wall 11 through which the fuel lines 10 are passed through. At the side facing the combustion chamber 2, the evaporator element 9 is covered by the cover 4 already described before which can in particular be formed from a metal sheet. The evaporator element 9 is arranged such that it ring-shaped surrounds the combustion air inlet 3. At the combustion air inlet 3, the evaporator element 9 comprises an uncovered fuel discharge portion 12 at which evaporated fuel can exit from the evaporator element 9. The other sides of the evaporator element 9 are—except for the fuel lines 10—each covered such that fuel can only exit from the evaporator element 9 at the fuel discharge portion 12. The fuel discharge portion 12 ring-shaped surrounds the combustion air inlet 3 so that fuel can be evenly supplied from all sides. It has to noted that the evaporator element 9 does not necessarily need to have a closed ring shape and that also several separate evaporator elements 9 can be arranged distributed over the circumference, as the case may be. The evaporator element 9 is thermally coupled to the widening portion 20 via the cover 4 such that, in operation of the mobile heating device, heat is transferred into the evaporator element 9 from the flame anchored in the widening portion 20 in order to provide the evaporation heat necessary for fuel evaporation there. An ignition element for starting the burner which at least partially protrudes into the combustion chamber and which is not depicted in FIG. 1 for reasons of simplicity can further be provided.

By arrangement of the evaporator element 9 in the described manner in which the fuel lines 10 are spatially spaced from the fuel discharge portion 12, even dispersion of the supplied liquid fuel in the evaporator element 9 is achieved such that the whole evaporator element 9 is utilized for fuel evaporation. By the described arrangement in which the outlets of the fuel lines are arranged more downstream in the main flow direction H than the fuel discharge portion 12, it is further achieved that the fuel exits from the evaporator element 9 with a directional component which is directed opposite to the main flow direction H. In this manner, a particularly homogeneous mixing of the exiting fuel with the combustion air exiting from the air guide device 6 is attained such that good mixing of combustion air and evaporated fuel is attained immediately at the combustion air inlet 3.

Figure 2:
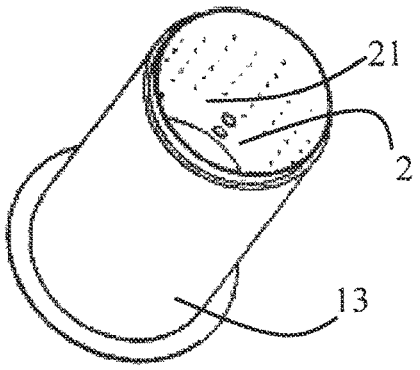
FIG. 2 is a schematic perspective illustration of the burner from FIG. 1.

The components of the burner 1 described above are surrounded at the outside by a substantially hollow cylindrical burner flange 13 which forms a flow space for supplied combustion air. The burner flange 13 further serves for fixation of the burner to further components of the mobile heating device situated at the rear side which are not illustrated. The burner flange 13 is formed such that a ring-shaped slit is formed between the inner side of the burner flange 13 and the outer side of the portion 21 of the combustion chamber wall which is adjacent to the widening portion 20, through which slit a part of the supplied combustion air can flow. At a downstream end with respect to the main flow direction H, the burner flange 13 is connected to the portion 21 such that the slit is closed there. As can be seen in FIGS. 1 and 2, the portion 21 of the combustion chamber wall adjacent to the widening portion 20 comprises a plurality of holes 22 and 23 through which combustion air can also enter into the combustion chamber 2. Due to the chosen geometry, the combustion air supplied by the combustion air conveying device is divided in a predetermined relation such that a part of the combustion air is supplied into the widening portion 20 via the air guide device 6 at the combustion air inlet 3 and another part of the combustion air is supplied into the combustion chamber via the slit and the holes 22 and 23.

By the described design, during operation of the burner 1 stable anchoring of the flame in the widening portion 21 is achieved over a large bandwidth of different heating powers, as will be described more in detail in the following.

The combustion air exiting from the air guide device 6 is mixed at the combustion air inlet 3 with the fuel exiting there from the evaporator element 9. Due to the strong swirl of the combustion air in combination with the strong widening of the widening portion 20, the current of the combustion air-fuel-mixture remains resting against the wall of the widening portion 20 due to acting centrifugal forces. Formation of thus-called dead water zones on the outer side at the wall can reliably be prevented even in the case of a strong widening. The current flows along the wall of the widening portion 20 with relatively high velocities such that during operation of the burner good convective heat transfer to the cover 4 and via thermal conduction to the evaporator element 9 placed behind it takes place.

From the point of view of fluid dynamics, the design of the widening portion 20 acts like a discontinuous widening of the cross-section such that with the swirling current a strong widening of the core swirl occurs. Due to the resulting local static pressures, subsequent to the widening of the core swirl a break-down of the core swirl occurs such that a strong back current opposite to the main flow direction H forms in a radially inner region close to the longitudinal axis Z, as schematically depicted by arrows in FIG. 1. With the described geometric design of the burner 1, the recirculation vortices forming in this manner have a position which is substantially independent from the mass flow of the combustion air-fuel-mixture such that self-stabilization or anchoring of the flame in the widening portion 20 takes place. Formation of these flow characteristics can be explained by the fact that the swirling current radially widens in the widening portion 20 wherein deceleration in the axial direction occurs. The tangential directional component of the velocity effects a radial pressure gradient whereby the static pressure decreases in the direction towards the longitudinal axis Z. Due to these pressure conditions, the recirculation zone forms.

Due to the described design, the burner 1 can be operated over a large bandwidth of different heating powers, in particular in a power range from 0.8 kW to approximately 20 kW.

The combination of the combustion chamber design and the evaporator element 9 enables stable operation even at relatively low heating powers. By the evaporator element 9, stable supply of fuel into the combustion chamber 2 takes place even if air bubbles should form in the fuel line 10. Due to the resulting self-stabilization or anchoring of the flame in the widening portion 20, high heat input into the evaporator element 9 takes place at high heating powers such that the required large amount of fuel per time can reliably be evaporated there. At a lower heating power, correspondingly smaller heat input takes place such that the process of fuel evaporation can also reliably be maintained to the desired extent over a large bandwidth of heating powers. By the achieved flowing-through of substantially the whole volume of the evaporator element 9, it is reliably acted against formation of residues in the evaporator element 9. A particularly cost-efficient design of the burner 1 is further enabled by the fuel supply via the evaporator element 9.

Since a well-defined, good mixing of fuel and combustion air is attained with the described design, a combustion which is very low in emissions is achieved. In the described mobile heating device, the combustion air is introduced into the widening portion 20 with a high flow velocity. In this manner, undesired back-burning can reliably be prevented.

SECOND EMBODIMENT

A second embodiment will be described in the following with reference to FIG. 6, wherein only the differences to the first embodiment will be described more in detail in order to avoid repeating and the same reference signs as in the first embodiment are used for the same elements or components.

The second embodiment differs from the first embodiment in that the fuel supply comprises an atomizing nozzle 90 for atomizing the liquid fuel instead of the evaporator element 9 for evaporating the liquid fuel provided in the first embodiment, as will be described more in detail. Also in the second embodiment, the widening portion 20 comprises a cross-section which widens with increasing distance from the combustion air inlet 3. Also in the second embodiment, the widening portion 20 is confined by a conical wall which however, in contrast to the first embodiment, is not formed by a separate cover 4 but by a rear wall 40 of the combustion chamber 2.

Further, in the second embodiment the through-bore 62 in the air guide device 6 is not covered by a plug 63 but the atomizing nozzle 90 is arranged in the through-bore 62 instead. The liquid fuel is supplied to the atomizing nozzle 90 via a fuel line 100, as schematically illustrated in FIG. 6. In the second embodiment, the air guide device 6 is arranged such that the air exiting from the air guide device 6 enters into a tapering portion 19 which is situated in front of the combustion air inlet 3. In the example shown in FIG. 6, the tapering portion 19 is formed by a tapering truncated cone. The tapering portion 19 surrounds the atomizing nozzle 90 and effects that the combustion air is forced to flow around the discharge region of the atomizing nozzle 90 after exiting the air guide device 6 and to thereby cool the latter. Thus, cooling of the atomizing nozzle 90 is effected by the supplied combustion air. In this manner it is further achieved that the reverse flow of hot gases from the combustion process in the combustion chamber 2 cannot reach to the atomizing nozzle 90. Furthermore, the reduction in cross-section effects an increase in the tangential velocity component of the through-passing combustion air and brings the axial velocity portion closer to the longitudinal axis Z.

Figure 6:
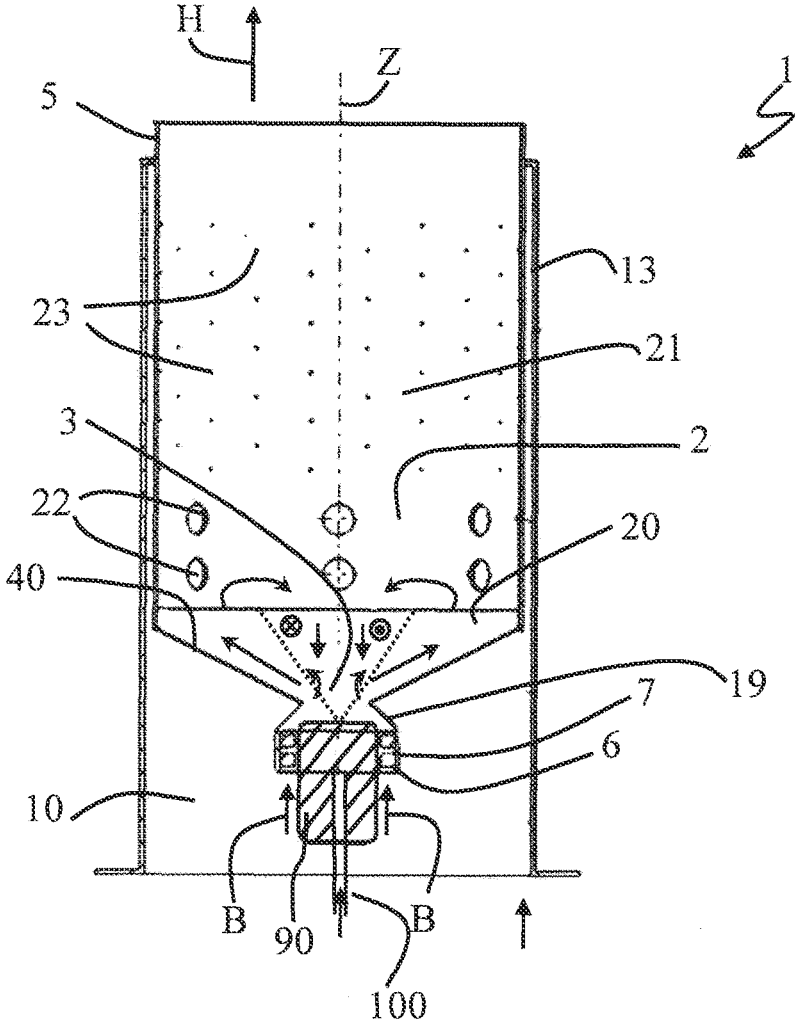
FIG. 6 is a schematic illustration of the burner of a mobile heating device according to a second embodiment.

The atomizing nozzle 90 is formed such that the fuel is discharged from the atomizing nozzle 90 into the widening portion 20 substantially hollow-cone-shaped, as schematically illustrated in FIG. 6 by dashed lines. The opening angle of the hollow cone with which the atomized fuel exits from the atomizing nozzle 90 is preferably selected such that the fuel enters the shear flow region which forms between the gases flowing off at the wall of the widening portion 20 and the gases flowing back in the axial recirculation zone. In the illustrated embodiment, the opening angle of the hollow cone with which the atomized fuel is supplied amounts to between 20° and 40°, preferably between 25° and 35°. Again the angle between the exiting atomized fuel and the longitudinal axis Z is designated as opening angle.

The invention claimed is:

1. A mobile heating device operated with liquid fuel, said mobile heating device comprising:

a combustion chamber having a widening portion and in which in operation combustion air and fuel are converted in a flaming combustion;

a central combustion air inlet adjacent the combustion chamber, the widening portion having a cross-section which widens with increasing distance from the combustion air inlet;

a fuel supply supplying fuel into the widening portion; and an air guide guiding combustion air into the widening portion at the central combustion air inlet with an axial flow component and with a flow component directing the combustion air in a circumferential direction such that an axial recirculation region forms in the widening portion in which gases flow in the direction towards the combustion air inlet oppositely to a main flow direction, the air guide device comprising a ring and including at least one spirally extending guide blade on an outer surface or the air guide, the spirally extending guide blade forming spirally extending channels.

2. The mobile heating device according to claim 1, in which the fuel supply includes at least one evaporator element for evaporating liquid fuel.

3. The mobile heating device according to claim 2, in which the at least one evaporator element at least partially surrounds the combustion air inlet.

4. The mobile heating device according to claim 2, in which the at least one evaporator element is ring-shaped and surrounds the combustion air inlet.

5. The mobile heating device according to claim 2, in which the at least one evaporator element is thermally coupled to the widening portion.

6. The mobile heating device according to claim 2, in which the evaporator element is partly covered by a cover and a fuel discharge portion is formed in a region of the evaporator element that is not covered by the cover.

7. The mobile heating device according to claim 6, in which the cover forms a wall of the widening portion.

8. The mobile heating device according to claim 6, in which the fuel discharge portion is arranged at the combustion air inlet.

9. The mobile heating device according to claim 2, in which the evaporator element is arranged such that evaporated fuel exits the evaporator element with a directional component directed opposite to the main flow direction.

10. The mobile heating device according to claim 1, in which the widening portion includes a continuously widening cross-section.

11. The mobile heating device according to claim 1, in which the widening portion widens with an opening angle of at least 20°.

12. The mobile heating device according to claim 1, in which the air guide is formed such that the combustion air is supplied into the widening portion with a swirl factor of at least 0.6.

13. The mobile heating device according to claim 1, in which the heating device is adapted such that the combustion air is supplied into the combustion air inlet with flow velocities being higher than turbulent flame velocities arising in the combustion chamber.

14. The mobile heating device according to claim 1, in which the combustion chamber continuously has a free flow cross-section.

15. The mobile heating device according to claim 1, in which the combustion chamber, adjacent to the widening portion, has a portion with a cross-section remaining substantially constant.

* * * * *